United States Patent [19]

Walker et al.

[11] 3,989,425

[45] Nov. 2, 1976

[54] UNITIZED SEAL BIASING SPRING ASSEMBLY FOR ROTARY MECHANISMS

[75] Inventors: Donald F. Walker, Peoria; Roger O. Bjerk, Edelstein; Harold C. Powers, Peoria, all of Ill.

[73] Assignee: Caterpillar Tractor Co., Peoria, Ill.

[22] Filed: May 1, 1975

[21] Appl. No.: 573,693

[52] U.S. Cl. ..... 418/122; 418/266; 277/81 P; 267/47

[51] Int. Cl.[2] ..... F03C 3/00

[58] Field of Search ..... 418/122, 123, 266, 267, 418/121; 267/47, 1.5; 277/81 P, 158, 159, 160

[56] References Cited

UNITED STATES PATENTS

| | | | |
|---|---|---|---|
| 1,292,324 | 1/1919 | Inshan | 418/121 |
| 1,460,987 | 7/1923 | Stanford | 267/47 |
| 2,078,395 | 4/1937 | Luthy | 267/1.5 |
| 2,084,828 | 6/1937 | Teetor | 267/1.5 |
| 2,110,562 | 3/1938 | Teetor | 267/1.5 |
| 3,152,552 | 10/1964 | Frenzel | 418/122 |
| 3,263,912 | 8/1966 | Frenzel | 418/122 |
| 3,667,877 | 6/1972 | Lamm | 418/122 |

FOREIGN PATENTS OR APPLICATIONS

| | | | |
|---|---|---|---|
| 1,196,452 | 7/1965 | Germany | 418/122 |
| 1,245,636 | 7/1967 | Germany | 418/121 |
| 195,407 | 4/1938 | Switzerland | 418/122 |
| 9,411 | 1842 | United Kingdom | 418/122 |

*Primary Examiner*—C. J. Husar

*Attorney, Agent, or Firm*—Wegner, Stellman, McCord, Wiles & Wood

[57] ABSTRACT

A long-lived, unitized seal biasing spring assembly for use in rotary mechanisms such as rotary engines. The rotary mechanism with which the invention is to be used includes an operating chamber and a rotor within the chamber. At least one seal retaining groove is provided in the rotor and the seal is retained in the groove and extends partially out of the groove into sealing engagement with the chamber. A unitized, multi-leaf spring assembly made according to the invention is disposed in the groove and engages the seal to bias the seal into sealing engagement. Through the use of a unitized construction, assembly is facilitated while the use of a multi-leaf biasing spring arrangement dramatically reduces spring stress substantially prolonging the useful life thereof.

3 Claims, 6 Drawing Figures

UNITIZED SEAL BIASING SPRING ASSEMBLY FOR ROTARY MECHANISMS

BACKGROUND OF THE INVENTION

This invention relates to rotary mechanisms such as rotary engines, compressors, or pumps, and, more particularly, to improved spring assemblies employed in biasing seals used in such mechanisms.

Single biasing springs for rotary mechanism seals, frequently known as energizng or backup springs, are conventionally employed in such mechanisms today. One difficulty posed by the use of single springs is that the same often lose their pre-load due to one or the other, or both, of high stress conditions and high operating temperatures.

Stresses are high since every effort is made to reduce the spring rate of the spring so that the pre-load of such springs on the seals will not vary appreciably during engine operation as the seals move into and out of the grooves. In addition, if the spring load rate is not minimized, manufacturing tolerances are too close, particularly for relatively long springs, to the point where they cannot be economically, reliably manufactured.

Operating temperatures are frequently high, particularly when the rotary mechanism is a rotary engine, for the reason that the seals are exposed to combustion gases. Frequently, the spring assemblies are similarly exposed when the seals are of the so-called gas energized variety.

Moreover, in all types of such rotary mechanisms, temperatures are relatively high because of the greater friction energy absorbed by the seals during operation than would typically be present in, for example, a reciprocating device employing piston rings as seals.

SUMMARY OF THE INVENTION

It is the principal object of the invention to provide a new and improved rotary mechanism. More specifically, it is an object of the invention to provide such a rotary mechanism wherein a seal biasing spring assembly is utilized and which is not substantially susceptible to loss of pre-load and which does not require the maintenance of close tolerances during manufacture.

The exemplary embodiment of the invention achieves the foregoing object in a rotary mechanism having an operating chamber with a rotor disposed therein. The rotor is provided with at least one seal retaining groove and a seal is located therein and extends partially out of the groove into sealing engagement with the chamber. A unitized, multi-leaf spring assembly is disposed in said groove to engage the seal to bias the seal into the aforementioned sealing engagement. The use of a multi-leaf spring assembly dramatically reduces the stresses which result in premature seal failure. The use of a unitized assembly facilitates installation of the several spring leaves.

According to the preferred embodiment, the spring assembly comprises a plurality of curved, superimposed, elongated leaf springs joined together at a corresponding point along the length of each with at least one end of each spring being free for relative movement with respect to the corresponding ends of each other spring.

According to one embodiment, the corresponding points on each of the springs are joined by a weld.

According to another embodiment of the invention, the corresponding points on the springs are joined by a tongue on one of the springs at least partially encircling the corresponding points of the other springs in sandwiching relation. In one embodiment, the tongue is generally transverse to the longitudinal axis of the spring and, preferably, two such tongues are provided on opposite sides of the springs.

According to another embodiment, the tongue comprises a longitudinal extension of one of the springs wrapped about corresponding ends of the remaining springs.

Where fretting between free ends of the spring is of concern, the invention contemplates the provision of a means disposed between the springs for preventing such fretting.

Other objects and advantages will become apparent from the following specification taken in connection with the accompanying drawings.

DESCRIPTION OF THE PREFERRED EMBODIMENTS

Figure 1:
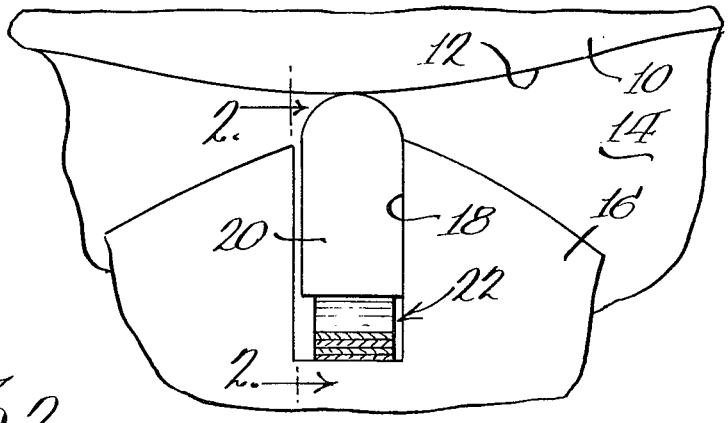
FIG. 1 is a fragmentary view of a rotary mechanism made according to the invention.

An exemplary embodiment of a rotary mechanism made according to the invention is illustrated in FIG. 1 in the form of a trochoidal type mechanism and, more specifically, in the form of a trochoidal engine of the so-called "Wankel" type. However, it is to be expressly understood that the invention is not restricted to trochoidal mechanisms or engines but may be advantageously employed in a variety of rotary mechanisms such as pumps, compressors, and non-trochoidal type rotary mechanisms, such as slant axis rotary mechanisms.

With reference to FIG. 1, the rotary mechanism is provided with a center housing 10 having an interior wall 12 which, together with a pair of end housings 14 (only one of which is shown), define an operating chamber. Within the chamber, a rotor 16 is conventionally journalled by means (not shown) and will conventionally include a plurality of seal retaining grooves 18 (only one of which is shown).

Within the groove 18, there is disposed a seal 20 which extends partially out of the groove 18 into engagement with the wall 12. To bias the seal 20 into good sealing engagement with the wall 12, a unitized, multi-leaf spring assembly, generally designated 22, is disposed in the groove 18 in engagement with the seal 20 to bias the latter into such sealing engagement.

Figure 2:
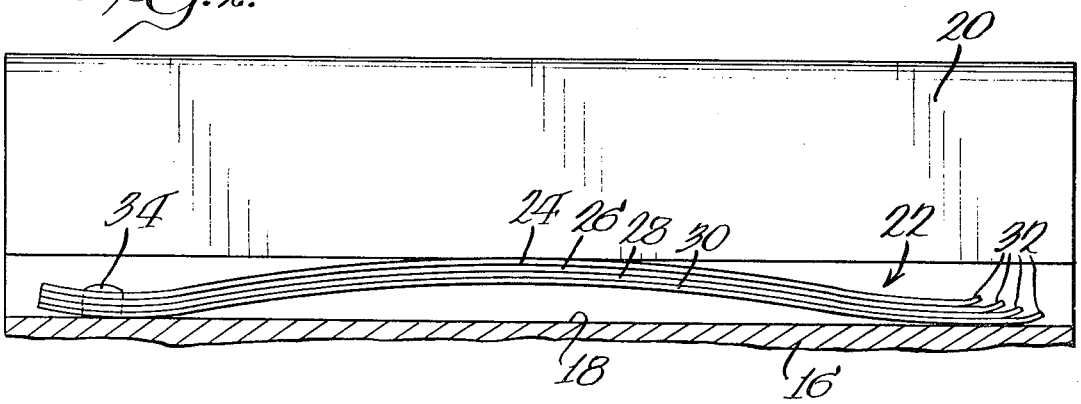
FIG. 2 is a sectional view taken approximately along the line 2—2 of FIG. 1.

With reference to FIG. 2, the spring assembly 22 is comprised of four curved, elongated spring leaves 24, 26, 28 and 30 in superposed relation. Each of the springs 24, 26, 28 and 30, at the right-hand end thereof is provided with an upturned curved portion 32 to provide substantially tangential contact of the corresponding ends of the springs 24, 26, 28 and 30. More specifically, the ends of the springs 24–30, inclusive, provided with the curved portions 32 are free for relative movement with respect to each other and, by reason of the provision of the curved portion 32 to provide such tangential contact, fretting tendencies at the point of contact between the springs are minimized.

The ends of the springs 24–30, inclusive, opposite from the curved portions 32 are joined together by means of a weld 34 to provide the aforementioned unitized assembly. As a consequence, the four springs 24–30 may be installed in the groove 18 as easily as a single spring.

Figure 3:
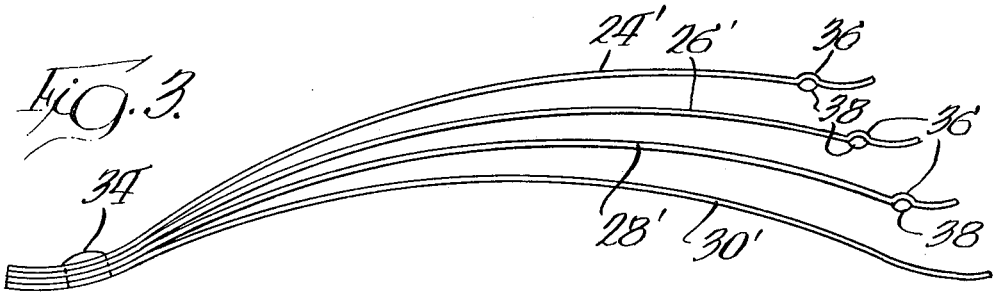
FIG. 3 illustrates a spring assembly made according to the invention along the lines of that illustrated in FIGS. 1 and 2 but additionally provided with anti-fretting means.

FIG. 3 illustrates a spring assembly similar to the spring assembly 22 prior to assembly with a seal 20 and a groove 18. In addition, the spring assembly in FIG. 3 is further provided with downwardly opening, curved portions 36 in at least three of the leaves, specifically, the spring leaves 24′, 26′ and 28′. Bonded within each of the downwardly open curved portions 36 is a body 38 of any conventional anti-fretting material. The body 38 extends somewhat below an extension of the lower surface of each of the corresponding springs so as to engage the upper surface of the next lower spring. The embodiment illustrated in FIG. 3 is particularly suitable for situations where fretting cannot be tolerated.

Like the embodiment illustrated in FIG. 2, the spring leaves of the embodiment of FIG. 3 are secured together at a corresponding point on each by means of a weld 34.

Figure 4:
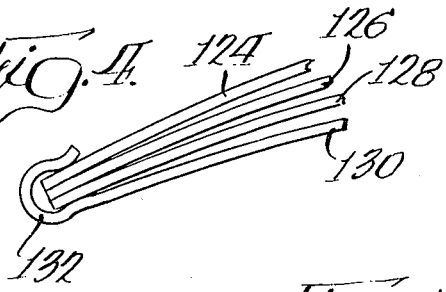
FIG. 4 illustrates a further embodiment of the invention.

FIG. 4 illustrates a further embodiment of the invention. Again, four elongated spring leaves 124, 126, 128 and 130 are employed. In order to secure corresponding points of the spring leaves 124 – 130 together to provide a unitized assembly one of the spring leaves, specifically, the spring leaf 130, includes a longitudinal extension 132 which defines a tongue. The tongue or longitudinal extension 132 is folded over the remaining spring leaves 124, 126 and 128 to partially encircle the same to develop a sandwiching relation to thereby maintain the four spring leaves in assembled relation.

In all other respects, the embodiment of FIG. 4 may be identical to the embodiments illustrated in FIGS. 2 and 3.

Figure 5:
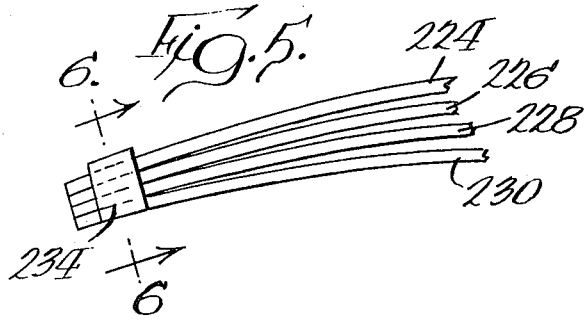
FIG. 5 illustrates still another embodiment of the invention.
Figure 6:
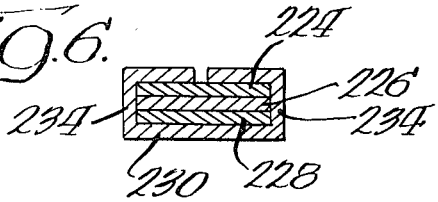
FIG. 6 is a sectional view taken approximately along the line 6—6 of FIG. 5.

Still a further embodiment of the invention is illustrated in FIGS. 5 and 6. Again, four spring leaves, 224, 226, 228 and 230 are employed. And, again, a tongue partially encircling the leaves 224, 226 and 228 is provided on the spring 230 to develop a sandwich relationship to maintain the assemblage. More specifically, the spring leaf 230 is provided with a pair of oppositely directed tongues 234 which extend from opposite sides in a direction transverse to the longitudinal axis of the leaf 230. The tongues 234 each partially encircle the remaining leaves 224, 226 and 228 as illustrated in FIG. 6 and are clamped in the relation shown to maintain such an assemblage.

From the foregoing, it will be appreciated that a multileaf spring assembly made according to the invention will have increased life over biasing means conventionally employed in rotary mechanisms by reason of the dramatic reduction in stress. Moreover, such assemblies may be easily installed in the mechanism by reason of their unitized construction.

It will also be appreciated that while the spring assemblies made according to the invention have been illustrated as having the individual springs joined together adjacent one end, if desired, the springs could be joined at corresponding points at any location intermediate their lengths. For example, the securing means of the embodiments of FIG. 2 or FIGS. 5 and 6 could be employed to join the springs together at their center, if desired.

What is claimed is:

1. In a rotary mechanism, the combination of:

means defining an operating chamber;

a rotor within said chamber;

at least one seal retaining groove in said rotor;

a seal retained in said groove and extending partially out of said groove into sealing engagement within said chamber; and a unitized, multi-leaf spring assembly freely received in said groove and engaging said seal to bias the seal into said sealing engagement, said spring assembly comprising a plurality of curved, superposed, elongated leaf springs joined together at a corresonding point on the length thereof by a weld, said corresponding point being a low-stress point, at least one end of each spring being free for relative movement with respect to the corresponding end of each other spring.

2. The rotary mechanism of claim 1 further including means disposed between said springs for preventing fretting adjacent said free ends.

3. The rotary mechanism of claim 1 wherein said weld is at the end of said assembly remote from said spring free ends.

* * * * *